United States Patent [19]

Siegle

[11] 4,019,486

[45] Apr. 26, 1977

[54] MOTOR IGNITION SYSTEM WITH MAGNETICALLY SELECTABLE GAS DISCHARGE DEVICES

[75] Inventor: Gert Siegle, Sperlingsstieg, Germany

[73] Assignee: Robert Bosch G.m.b.H., Stuttgart, Germany

[22] Filed: Nov. 14, 1974

[21] Appl. No.: 523,867

[30] Foreign Application Priority Data

Nov. 16, 1973 Germany ..... 2357188

[52] U.S. Cl. ..... 123/148 E; 123/146.5 A; 123/148 DK; 200/19 R; 315/209 R

[51] Int. Cl.[2] ..... F02P 1/00

[58] Field of Search ... 123/148 E, 148 ND, 148 DK; 315/209 R, 209 M, 209 T, 180; 200/19 R

[56] References Cited

UNITED STATES PATENTS

| | | | |
|---|---|---|---|
| 1,952,121 | 3/1934 | Critchfield | 123/148 DC |
| 2,451,482 | 10/1948 | Flint | 123/148 DC |
| 3,032,683 | 5/1962 | Ruckelshaus | 315/180 |
| 3,127,540 | 3/1964 | Collins | 315/209 R |
| 3,184,639 | 5/1965 | Parish | 315/209 R |
| 3,406,314 | 10/1968 | Parish | 315/209 |
| 3,443,152 | 5/1969 | Segall et al. | 315/209 R |
| 3,444,431 | 5/1969 | Goldberg | 315/209 R |
| 3,595,212 | 7/1971 | Barnes | 315/180 |

*Primary Examiner*—C. J. Husar
*Assistant Examiner*—Paul Devinsky
*Attorney, Agent, or Firm*—William R. Woodward

[57] ABSTRACT

A magnetic field, such as produced by a surrounding coil, lowers the breakdown voltage of a gas discharge device in series with a spark plug so that the ignition voltage will preferentially go to that spark plug rather than to others in series with gas discharge devices having no magnetic field. The switching of the field-producing coils of the gas discharge devices in accordance with the firing cycle of an engine may be produced by a transistor switching circuit excited by a simple rotary electric timing device that also times the spark pulses. A gas discharge device for this system is shown having an elongated cup-shaped anode and rodlike cathode, which can also be made to serve as the sealing tube, centered within the anode. Gas discharge devices for this system are shown in U.S. Pat. No. 3,951,144 to the same assignee.

10 Claims, 3 Drawing Figures

MOTOR IGNITION SYSTEM WITH MAGNETICALLY SELECTABLE GAS DISCHARGE DEVICES

This invention relates to an ignition distribution system for an internal combustion engine having two or more spark plugs that receive their exciting voltage from the secondary winding of an ignition coil or transformer and, more particularly, a system of the type in which an auxiliary spark gap is connected in series between each of the spark plugs and the aforesaid secondary winding. The ignition system, of course, serves to ignite a compressed fuel-air mixture in the respective cylinders of the engine.

In multi-cylinder internal combustion engine in which each cylinder is provided with at least one spark plug, it is necessary to distribute the ignition voltage pulses in a certain sequence to the spark plugs of the individual cylinders. A so-called distributor is generally used in which a contact finger is moved past two or more fixed contacts connected to the individual spark plugs to connect the latter in turn to the secondary winding of the ignition coil and provide a path for the high-voltage pulse. At the particular moment at which the fuel-air mixture is to be ignited in a particular cylinder, the contact finger is directly opposite the particular fixed contact related to the spark plug in the particular cylinder, so that the spark available at this moment as the result of a breakdown between the contact finger and this fixed contact will generate a spark in the selected spark plug to ignite the explosive mixture.

The operation of the flashover distributor just described can easily be disturbed if water condensation with dirt particles or nitrogen oxides generated by electrical sparks come into contact with the inner wall of the distributor and form leakage paths between the fixed contacts, which in known devices can cause energy losses and the danger of a false ignition distribution.

It is an object of the present invention to provide an ignition distribution system of the flashover type in which the difficulties above described can be avoided.

SUMMARY OF THE INVENTION

Briefly, gas discharge devices are provided between the respective spark plugs and the source of ignition pulses, which devices are so constituted that the breakdown voltage at which a discharge occurs is subject to substantial change by the application of a magnetic field. For this purpose the anode of each gas discharge device is made hollow, preferably in the form of an elongated cylindrical cup and the cathode is centered within it, coaxially in the elongated form. A coil concentric or coaxial with the electrodes is provided, outside the envelope containing the discharge gas, in order to provide a magnetic field for control purposes. The gas discharge devices associated with the respective spark plugs are sequentially influenced by a magnetic field for preferential breakdown during successive period, each bracketing the moment at which an ignition pulse is provided by the ignition coil secondary winding. In the case in which the magnetic field is produced electromagnetically by coils around the respective gas discharge devices, an electronic switching circuit responsive to a plurality of transducer devices sequentially excited by an exciting device rotated by the engine at camshaft speed controls the operation of the coils in accordance with the firing cycle and also causes the spark pulses to be generated in the spark coils.

At least the surface of the cathode electrode in the neighborhood of the discharge is preferably made of a metal resistant to disintegration by sputtering. Gas discharge devices particularly suitable for the present ignition system are described in my U.S. Pat. No. 3,951,144

The invention is further described by way of example with reference to the accompanying drawings, in which.

Figure 1:
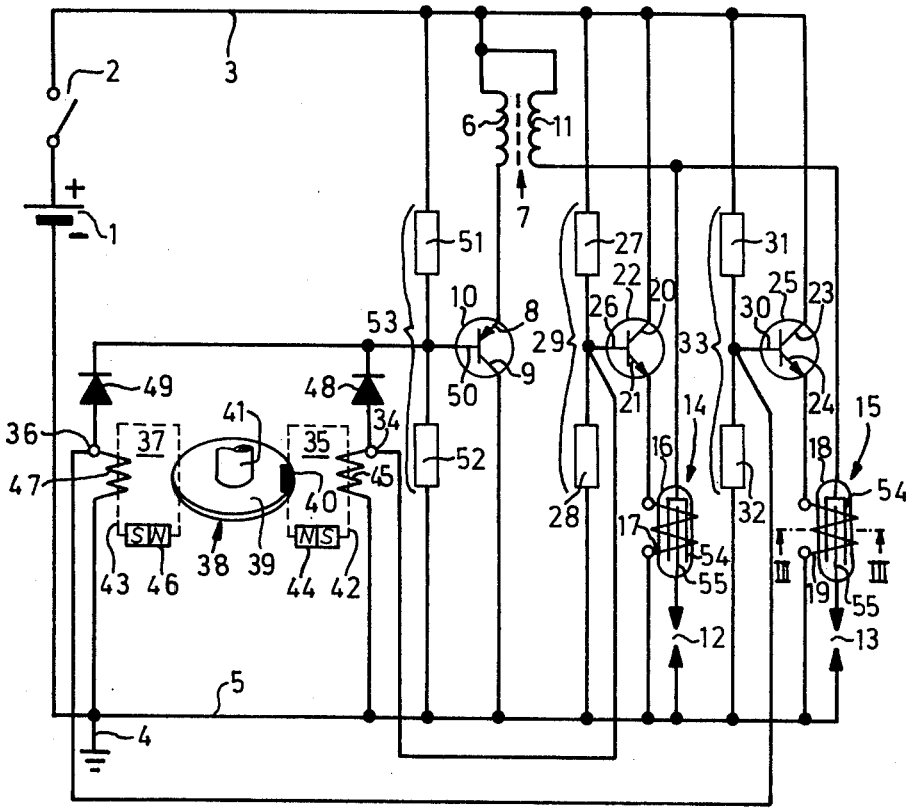
FIG. 1 is a circuit diagram of an ignition distribution system embodying the invention.

FIG. 1 shows an ignition system of a two-cylinder, four-cycle internal combustion engine, not shown, of a motor vehicle, likewise not shown, the ignition system being supplied by current from a source 1 which, as illustrated, is the battery of the vehicle. A power supply bus 3 of the circuit is connected through an ignition switch 2 to the positive pole of the current supply source 1, of which the negative pole is grounded to the vehicle chassis and connected to a grounded supply bus 5. The primary winding 6 of an ignition coil 7 is connected in series with the switching path formed between the emitter 8 and collector 9 of a transistor 10 that serves as a controllable electronic switch, this series combination being connected in circuit with the current supply with the primary winding 6 connected to the positive bus 3 and the transistor collector 9 connected to the ground bus 5.

The secondary winding 11 of the ignition coil 7 serves to supply ignition voltage to a plurality of spark plugs, in the illustrated case to spark plugs 12 and 13, each of which is situated in a different cylinder, not shown, of the engine. The spark plugs 12 and 13 are to be fired at different ignition times in accordance with the firing cycle of the engine. For the purpose of distributing the ignition pulses to the spark plugs 12 and 13, the spark plug 12 is connected in series with a gas discharge device 14 and the spark plug 13 similarly with the gas discharge device 15. In these series circuit combinations, one side of the spark plug is connected to the ground bus 5 and the anode of the gas discharge device is connected to a terminal of the secondary winding 11 of the ignition coil 7, the other end of which is connected to the positive power supply bus 3.

The selection of the particular spark plug which is to receive the ignition voltage during the particular portion of the firing cycle is determined by exposing the gas discharge device connected to the selected spark plug to the influence of a magnetic field.

In the illustrated case the magnetic field is generated by passing current through a coil. The gas discharge device 14 is provided with a hollow envelope 16 on which is mounted an encircling coil 17 and likewise the gas discharge device 15 similarly has a coil 19 surrounding its envelope 18. The coil 17 is in series across the power supply with the switching path constituted between the collector 20 and the emitter 21 of a transistor 22 serving as an electrically controllable ignition switch, this series combination beting connected on the coil side to the ungrounded power bus and on the transistor collector side through the grounded bus 3. The coil 19 likewise is connected in series across the battery with the switching path constituted between the collector 23 and the emitter 24 of another transistor 25 serving as an electrically controllable ignition switch, this series combination also being connected on the coil side with the ungrounded power supply bus 5 and on the transistor collector side to the ground bus 3. The base 26 of transistor 22 is connected to the tap of a voltage divider 29 energized by the battery voltage and consisting of the resistors 27 and 28. Similarly the base 30 of the transistor 25 is connected to the tap of a voltage divider 33 likewise connected across the battery voltage and in this case consisting of the resistors 31 and 32.

Figure 2:
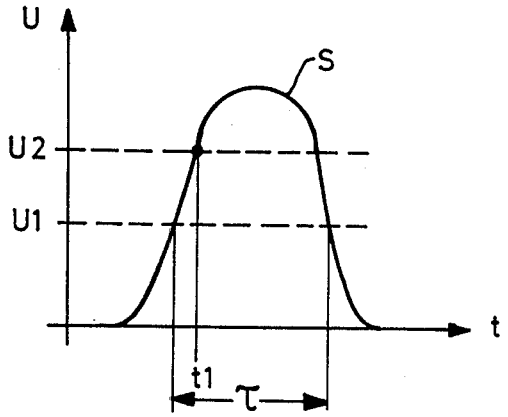
FIG. 2 is a graph showing the time course of a control signal generated in the circuit of FIG. 1.
Figure 3:
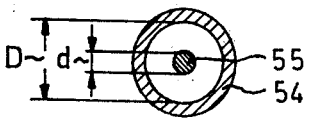
FIG. 3 is a cross section of the electrodes of a gas discharge device 15 of FIG. 1, along the line III—III of FIG. 1.

The base 26 of transistor 22 is also connected to the output terminal 34 of a signal transducer 35, while the base 30 of the transistor 25 is similarly also connected to the output terminal 36 of a signal transducer 37. The signal transducers 35 and 37, which in the illustrated case operate by induction, are exposed to the influence of a rotatable signal initiator 38 arranged to be driven by the engine so as to produce a control signal S (FIG. 2) in each of the signal transducers in succession. The control signal has the polarity suitable for generating an ignition pulse and has more or less the wave shape of a sinusoidal half wave. The signal initiator 38 comprises a disc 39 of magnetically nonconducting material, such as brass or synthetic resin, provided in its peripheral zone with an armature 40 of magnetically conducting material, for example, soft iron, stretching over a small sector of the peripheral portion of the disc 39. The disc 39 is affixed to the shaft 41, which during operation of the engine turns at camshaft speed.

The armature 40, which can be regarded as an exciter piece, is driven through the air gap, not shown in the drawing, of the magnetic circuit 42 shown in dashed lines in FIG. 1 of the signal transducer 35 and after rotation through a further angle of 180° is similarly driven through the air gap, not shown, of the magnetic circuit 43, shown in dashed lines, of the signal transducer 37. The magnetic circuit 42 concentrates the lines of force of a permanent magnet 44 and this magnetic field passes through the coil 45 of the transducer 35. The coil 45 has one end connected to the ground bus 5 of the power supply and the other end connected to the output terminal 34. The magnetic circuit 43 similarly concentrates the lines of force of a permanent magnet 46 and has a field that goes through the coil 47 of the transducer 37, the coil having one end connected to the grounded bus 5 of the power supply and the other end connected to the output terminal 36.

Both the output terminal 34 of the signal transducer 35 and the output terminal 36 of the signal transducer 37 are connected through respective blocking diodes 48 and 49 to the base 50 of the transistor 10. These blocking diodes are so poled as to the made conductive by the control signal S.

The base 50 of the transistor 10 is also connected to the tap of a voltage divider 53 connected across the power supply and consisting of the resistor 51 and 52. The voltage divider 53 is so dimensioned in comparison to the voltage dividers 29 and 33, as shown in the voltage-time diagram given in FIG. 2 that the switching threshold U1 at which the switching path 20-21 of the transistors 22 or the path 23-24 of the transistors 25 are switched to the conducting condition by the control signal S lies at a lower voltage than the switching threshold U2 at which the switching path 8–9 of the transistor 10 is put into the nonconducting condition. In this manner it is assured that the switching over of the transistor 10 which starts the production of an ignition pulse will take place within the period $\tau$, during which the transistor 22 or the transistor 25, as the case may be, is kept in its conducting condition.

Of course it is also possible to generate the control signal S with a pulse shaper circuit and, if necessary, utilize a conventional interrupter switch to initiate the pulse.

For the electrode material of the gas discharge devices it is appropriate to use a metal resistant to sputtering effects belonging to the fourth or fifth column of the periodic table of the elements, preferably zirconium. Other suiaable materials for this purpose are tungsten, aluminum, iron or an alloy consisting of iron, cobalt and nickel or of iron, chromium and nickel. When any of the materials just mentioned is used, the envelope of the gas discharge device should preferably contain argon. When hydrogen is used as the gas filling of the device, tungsten and iron, the latter particularly in the form of stainless steel, or one of the previously named alloys are particularly suitable. In the case of nitrogen-containing gas fillings, the electrode material may usefully be iron, zirconium nitride, titanium nitride and tantalum nitride. The sputter-resistant metal or nitride should be provided at least on the surface of the electrode in the region of the electrode in which electric breakdown occurs. Indeed it can be quite sufficient to provide the coating of a sputter-resistant metal only on the exposed portion of the cathode electrode 55.

In suitable cases the envelope 16, 18 can be dispensed with when the anode electrode 54 is of cup or pot shape and the cathode electrode 55 closes off the open end with the insertion of an insulating body.

For the usual ignition voltage of about 25,000 volts, a useful gas discharge device to serve as the device 14 or the device 15 in FIG. 1 can have an anode electrode 54 with an internal diameter D of 14 mm and a tungsten cathode electrode with a diameter $d$ of 6 mm. In this example it is suitable to use a gas filling of hydrogen under a pressure of 0.1 torr and to provide a magnetic field strength for control purposes of about 600 oersteds. In this case the gas discharge devices can contain a little titanium hydride in order to maintain the gas pressure sufficiently constant.

The ignition system just described has the following mode of operation:

As soon as the ignition switch 2 is closed, the ignition system is ready for operation. If the armature 40 is at the moment outside the magnetic circuits 42 and 43, the base 50 of transistor 10 is biassed by the voltage divider 53 sufficiently negative to the emitter 8 that the switching path 8–9 is held in the conducting condition. In consequence the primary winding 6 of the ignition coil 7 carries a current furnished by the current source 1.

The base 26 of the transistor 22 is biassed by the voltage divider 29 sufficiently negative to the emitter 21 that the switching path 20-11 is held in the nonconducting condition. Likewise the base 30 of the transistor 25 is biassed by the voltage divider 33 sufficiently negative with respect to the emitter 24 that the switching path 23–24 is held in its nonconducting condition. When the armature 40 then passes through the magnetic circuit 42 as the disc 39 turns, an alternating voltage period is formed, the first half wave of which forms the control signal S shown in FIG. 2; i.e., this half wave is positive with reference to the grounded power supply bus 5. When the control signal S reaches the switching threshold U1, the output terminal 34 of the coil 45 of the signal transducer 35 and hence the base 26 of transistor 22 is brought sufficiently positive compared to the emitter 21 of that transistor that the switching path 20–21 becomes conducting. In consequence, a current flows from the current source 1 through the coil 17 of the gas discharge device 14 and the latter is influenced by the magnetic field so produced.

When the control signal S reaches the switching threshold U2, the base 50 of transistor 10 is given a postive bias relative to the emitter 8 by current through the diode 48 from the output terminal 34 of the signal transducer coil 45 to a sufficient extent to put the switching path 8-9 of the transistor 10 into its current-blocking condition. In consequence the flow of current in the primary winding 6 of the ignition coil 7 is interrupted, which in turn causes a high-voltage transient kick in the secondary winding of the coil. This high-voltage pulse becomes the ignition pulse for the spark plug 12, where it produces an electric breakdown spark and ignites the compressed fuel-air mixture in the cylinder in which the spark plug 12 is located.

The spark plug 12 receives the ignition voltage pulse as just described because the magnetic field of the coil 17 influences the gas discharge gap of the device 14, reducing the voltage needed for breakdown to a lower value than the voltage needed to break down the gas discharge device 15 which at the moment is not under the influence of a magnetic field.

As soon as the control signal S goes back below the switching threshold U2 the switching path 8-9 of the transistor 10 goes back into its conducting condition. When the control signal drops below the switching threshold U1, the switching path 20-21 of the transistor 22 goes back into its nonconducting condition and the current through the coil 17 is interrupted.

When the rotating disc 39 moves the armature 40 through the magnetic circuit 43, a newly generated control signal S of the kind described will switch the switching path 23-24 of the transistor 25 into the conducting condition to energize the coil 19 when the switching threshold U1 is reached. The discharge path of the gas discharge device 15 will then be under the influence of a magnetic field. As soon as the control signal S reaches the switching threshold U2 and initiates an ignition pulse by blocking the switching path 8-9 of the transistor 10, the spark plug 13 receives ignition potential because of the preferential breakdown of the gas discharge device 15. The explosive mixture in a cylinder of the spark plug 13 is accordingly ignited.

As may be seen from the example just illustrated, in the ignition system of the invention, a simple rotating device is indeed used to time the ignition operation, but a rotating member for actual distribution of the ignition voltage is not strictly necessary, which makes possible dispensing with the conventional spark distributor or at least makes possible a drastic simplification of such a distributor.

Of course, instead of the electrically controllable switches 22 and 25 a mechanical switching arrangement can be provided to assure that when the ignition pulse is produced one of the coils 17 and 19 will be energized in accordance with the firing cycle of the engine. The conventional spark distributor, already described in the introduction, can be modified for this purpose by providing a graphite sliding contact operating under spring pressure on the free end of the contact finger of the distributor and to provide the fixed contacts in the form of contact paths insulated one from the other over which the sliding contact passes. Then, whenever an ignition voltage pulse is generated, the sliding contact will always be in contact with one of the fixed contact paths. These contact paths will of course lead to the respective coils 17 and 19 and through them to the grounded current supply bus 5, the sliding contact in such case being of course connected to the ungrounded supply bus 3.

The gas discharge devices 14 and 15 together with their conditioning coils 17 and 19, as a matter of construction layout, can be placed in practically any desired location on the engine, thus, for example, adjacent to the ignition coil or built into the respective spark plugs.

I claim:

1. In an ignition distribution system for a multi-cylinder internal combustion engine having a plurality of spark plugs arranged to receive their ignition voltage selectively from a common source, the improvement comprising the combination of:

a low-voltage source of current and means for energizing said ignition voltage source from said low-voltage current source during repeated pre-ignition periods;

a gas discharge device (16,18) interposed in series between each spark plug and said ignition voltage source, each said gas discharge device being so constituted that its gas discharge characteristic is subject to variation by the application of a magnetic field;

a first semiconductor switch (10) having a first and a second state for enabling said ignition voltage source to be energized in said first state and for causing a high voltage discharge from said voltage source in said second state;

means (35,37,38,48,49,53) controlled by the rotation of said engine for changing the state of said switch (10) from said first state to said second state at moments corresponding respectively to predetermined positions in a rotary cycle of said engine, for thereby initiating a discharge in a selected spark plug, and for restoring the state of said switch (10) to said first state promptly after said discharges are completed, and means controlled by the rotation of said engine (35,37,38,29,33,22,25,17,19) for selectively applying, by current from said low-voltage source, a magnetic field in turn to each of said gas discharge devices without immediately producing a discharge therein upon the application of said field, and for applying said field in each case for a predetermined engine-rotation-controlled period beginning prior to one of said position corresponding moments and ending after the state of said first switch is next restored to said second state, said field applying means including a plurality of additional semiconductor switches (22,25) and a coil (17,19) individually encircling each of the respective gas discharge devices (16,18) and arranged for switching in succession to said low-voltage current source through one of said additional switches.

2. Improvement in an ignition distribution system as defined in claim 1 in which each gas discharge device comprises a gas discharge path between a cathode electrode (55) and an anode electrode (54) and located within an enclosing gas-filled hollow envelope (16,18) of magnetically nonconducting material.

3. Improvement in an ignition distribution system as defined in claim 2 in which said cathode electode (55) is surrounded by said anode electrode (54).

4. Improvement in an ignition distribution system as defined in claim 3 in which said anode electrode (54) concentrically surrounds said cathode electrode (55) and both said electrodes (54, 55) are concentrically encircled by a coil (17,19) provided on the exterior of said envelope (16,18) and arranged to provide a magnetic field varying the discharge characteristic of the discharge device.

5. Improvement in an ignition distribution system as defined in claim 2 in which at least the surface portion of said cathode electrode (55) in the region where discharges take place is made of a metal highly resistant to disintegration by sputtering effects.

6. Improvement in an ignition distribution system as defined in claim 2 in which at least one of the said two electrodes (54,55) is in the form of a sealed tube extending into the interior of said envelope.

7. Improvement in an ignition distribution system as defined in claim 1 in which said coils (17,19) encircle the respective gas discharge paths (14,15) of the respective gas discharge devices.

8. Improvement in an ignition distribution system as defined in claim 1, in which said ignition voltage source is an ignition transformer having a primary winding for energization thereof and a secondary winding for delivery of the ignition voltage and in which, further, said first semiconductor switch is closed in said first state to enable said transformer to be energized by its primary winding and is opened in said second state to interrupt the current in said primary winding and cause delivery of the ignition voltage by said secondary winding.

9. Improvement in an ignition distribution system as defined in claim 1, in which a single engine-driven rotor (48) and a plurality of signal transducers (35,37) are provided in common for said means for changing the state of said first switch and said means for selectively applying a magnetic field to said gas discharge devices and in which the respective outputs of said transducers are provided through individual voltage comparison circuits (29,33) respectively to said additional semiconductor switches (22,25) to control the timed energization of the respective coils (17,19) of said gas discharge devices (16,18), and in which, further, the outputs of said transducers (35,37) are supplied through isolating diodes (48,49), in parallel, to an additional voltage comparison circuit for control of said first semiconductor switch (10) by said additional comparison circuit.

10. Improvement in an ignition distribution system as defined in claim 9, in which said voltage comparison circuits are biasing resistive voltage dividers energized by said low-voltage current source for applying a bias voltage to the control electrodes of the respective semiconductor switches.

* * * * *